US005954031A

United States Patent [19]

Ogiso et al.

[11] Patent Number: 5,954,031

[45] Date of Patent: Sep. 21, 1999

[54] FUEL DELIVERY APPARATUS IN V-TYPE ENGINE

[75] Inventors: Makoto Ogiso, Toyota; Toshio Suzuki, Okazaki, both of Japan

[73] Assignee: Toyota Jidosha Kabushiki Kaisha, Toyota, Japan

[21] Appl. No.: 08/783,657

[22] Filed: Jan. 15, 1997

[30] Foreign Application Priority Data

Jan. 16, 1996 [JP] Japan ..... 8-005217

[51] Int. Cl.[6] ..... F02M 7/00

[52] U.S. Cl. ..... 123/447; 123/456; 123/467

[58] Field of Search ..... 123/468, 469, 123/470, 456, 497, 447, 467

[56] References Cited

U.S. PATENT DOCUMENTS

| | | | |
|---|---|---|---|
| 3,507,263 | 4/1970 | Long | 123/456 |
| 3,783,844 | 1/1974 | Goral | 123/470 |
| 4,205,637 | 6/1980 | Ito et al. | 123/447 |
| 4,510,909 | 4/1985 | Elphick | 123/469 |
| 5,056,489 | 10/1991 | Lorraine | 123/468 |
| 5,231,958 | 8/1993 | Takahashi et al. . | |
| 5,433,182 | 7/1995 | Augustin | 123/456 |
| 5,445,130 | 8/1995 | Brummer | 123/470 |
| 5,577,479 | 11/1996 | Popp | 123/456 |
| 5,590,631 | 1/1997 | Tuckey | 123/447 |

FOREIGN PATENT DOCUMENTS

| | | |
|---|---|---|
| 0019529 | 11/1980 | European Pat. Off. . |
| 0678664 | 10/1995 | European Pat. Off. . |
| 6354862 | 4/1988 | Japan . |
| 331573 | 2/1991 | Japan . |
| 8144889 | 6/1996 | Japan . |
| 1567041 | 5/1980 | United Kingdom . |

*Primary Examiner*—Carl S. Miller
*Attorney, Agent, or Firm*—Kenyon & Kenyon

[57] ABSTRACT

An apparatus deliveries fuel to a V-type engine having a first bank and a second bank. The apparatus has a first delivery pipe disposed in association with the first bank, a second delivery pipe disposed in association with the second bank and a fuel pipe for supplying the fuel from a fuel tank to the first delivery pipe and the second delivery pipe. Each delivery pipe has an injector for injecting the fuel from the delivery pipe to a cylinder of the engine. The fuel pipe includes a supply pipe connected with an end of the first delivery pipe to supply the fuel from the fuel tank to the first delivery pipe and a communicating pipe for communicating the end of the first delivery pipe with an end of the second delivery pipe. A first damping element is disposed at the end of the first delivery pipe to damp pressure fluctuation of the fuel supplied from the supply pipe.

5 Claims, 10 Drawing Sheets

FUEL DELIVERY APPARATUS IN V-TYPE ENGINE

BACKGROUND OF THE INVENTION

1. Field of the Invention

The present invention relates to a fuel delivery apparatus that delivers fuel to an engine. More particularly, the present invention relates to a fuel delivery apparatus that accurately delivers fuel to a V-type engine.

2. Description of the Related Art

Return type fuel delivery apparatuses are widely used for supplying fuel in engines. This type of fuel delivery apparatus includes a pressure regulator, a delivery pipe and a return pipe. The pressure regulator, which is located at one end of the delivery pipe, controls the fuel pressure in the delivery pipe to approximate a predetermined pressure level. Surplus fuel in the pressure control operation is returned to a fuel tank via the return pipe.

To simplify the structure of the fuel delivery apparatus, returnless type fuel delivery apparatuses having no return pipe have been used. This type of fuel delivery apparatus has been classified into two groups: complete returnless type and simplified returnless type. A complete returnless type fuel delivery apparatus returns no fuel to the fuel tank. This apparatus includes a fuel pump located in the fuel tank. The pump is controlled for sending fuel from the fuel tank to the delivery pipe based on the detected pressure of the fuel in the delivery pipe. A simplified returnless type fuel delivery apparatus, on the other hand, recirculates fuel within the fuel tank. In this apparatus, a fuel pump is located in the fuel tank and connected to a delivery pipe via a fuel pipe. A pressure regulator is also located in the fuel tank and controls the pressure of the fuel sent to the fuel pipe from the fuel pump. Surplus fuel in the pressure control operation is directly returned to the fuel stored in the tank.

Complete returnless type fuel delivery apparatuses have a drawback in that it is difficult to accurately control the fuel pressure in the delivery pipe. Therefore, simplified returnless type fuel delivery apparatuses are more commonly used.

The above two types of returnless type fuel delivery apparatuses control the fuel pressure from the fuel tank within the tank, which is distant from the delivery pipe. Therefore, when fuel pressure in the delivery pipe becomes temporarily low as the injector opens, fluctuation of the fuel pressure in the delivery pipe dissipates more slowly than in return type fuel delivery apparatuses. This tendency appears especially in a simplified returnless type fuel delivery apparatuses, since fuel pressure is controlled by the pressure regulator in the fuel tank, which is distant from the delivery pipe.

The fluctuation of fuel pressure sometimes remains in the delivery pipe, depending on the engine speed, until the next time the injector is opened. In this case, such fluctuation, in synergy with another fluctuation generated by another injector's opening, generates continuous pressure fluctuation in the delivery pipe. If the frequency of this fluctuation matches the resonance frequency of the delivery pipe, resonance occurs and continues intermittently. The resonance frequency of the delivery pipe and the engine speed at which the resonance occurs tend to become lower as the delivery pipe is formed longer.

In a V-type engine shown in FIG. 9 (FIG. 9 shows the intake-manifold of a six-cylinder V type engine), the pressure fluctuation causes variation of the air-fuel ratio in a practical engine speed region. Smooth rotation of the engine is thus hindered.

The V-type engine has a pair of delivery pipes 101, 102, each of which is arranged along a bank of cylinders. A supply pipe 104 is connected to the upstream end of the first delivery pipe 101. The downstream end of the first delivery pipe 101 is connected to the upstream end of the second delivery pipe 102 by a pipe 103. In other words, the delivery pipes 101, 102 are connected in series. This elongates the fuel passage.

The relationship between the changes of fuel pressure in the delivery pipes 101, 102 and fuel injection timing will now be described with reference to FIG. 10. The upper half of FIG. 10 is a graph showing changes of the fuel pressures in the delivery pipes 101, 102. The lower half of FIG. 10 is a timing chart showing the fuel injection timing (fuel injection command signals) of first to sixth cylinders.

As shown in FIG. 10, in a fuel delivery apparatus shown in FIG. 9, fuel pressure fluctuations of the substantially identical waveforms occur at the same timing in the delivery pipes 101, 102. When fuel is injected from one of the injectors (not shown) connected to the first delivery pipe 101 into a first cylinder #1, fuel pressure fluctuation occurs not only in the first delivery pipe 101 but also in the second delivery pipe 102. This fuel pressure fluctuation remains in the second delivery pipe 102 until fuel is injected into a second cylinder #2 from an injector (not shown) connected to the pipe 102.

As the intervals between each fuel injection become shorter, the intervals between pressure fluctuation generated by the fuel injections also becomes shorter. When the frequency of the pressure fluctuation matches the resonance frequency of the delivery pipes, resonance occurs in the delivery pipes as shown in FIG. 11.

The resonance fluctuates the pressure at which fuel is injected into intake ports (not shown) from injectors. Thus, the injected amount of fuel fluctuates. The solid line in the upper half of FIG. 12 shows the oscillating waveform of the fuel pressure caused by the resonance, while the broken line shows an average fuel pressure. The lower half of FIG. 12 is a timing chart showing the fuel injection timing (fuel injection command signals).

When a valley (or a peak) of the oscillating waveform of the fuel pressure synchronizes with a fuel injection release, fuel is injected into a suction port at a pressure that is by far lower (or by far higher) than the average fuel pressure. This varies the amount of injected fuel per unit of time. Accordingly, the air-fuel ratio in the engine deviates from the air-fuel ratio computed based on the average fuel pressure. This prevents the implementation of desired engine characteristics.

SUMMARY OF THE INVENTION

Accordingly, the present invention provides a fuel delivery apparatus that prevents resonance in delivery pipes in a practical engine speed region.

The present invention provides a fuel delivery apparatus that minimizes variation of the air-fuel ratio of the air-fuel mixture injected from the injector.

The apparatus according to the present invention delivers fuel to a V-type engine having a first bank and a second bank. The apparatus has a first delivery pipe disposed in association with the first bank, a second delivery pipe disposed in association with the second bank and a fuel pipe for supplying the fuel from a fuel tank to the first delivery pipe and the second delivery pipe. Each delivery pipe has an injector for injecting the fuel from the delivery pipe to a cylinder of the engine. The fuel pipe includes a supply pipe connected with an end of the first delivery pipe to supply the fuel from the fuel tank to the first delivery pipe and a communicating pipe for communicating the end of the first delivery pipe with an end of the second delivery pipe. First damping means is disposed at the end of the first delivery pipe to damp pressure fluctuation of the fuel supplied from the supply pipe.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION

An embodiment of a fuel delivery apparatus according to the present invention in a V type engine will now be described with reference to FIGS. 1 to 5.

Figure 1:
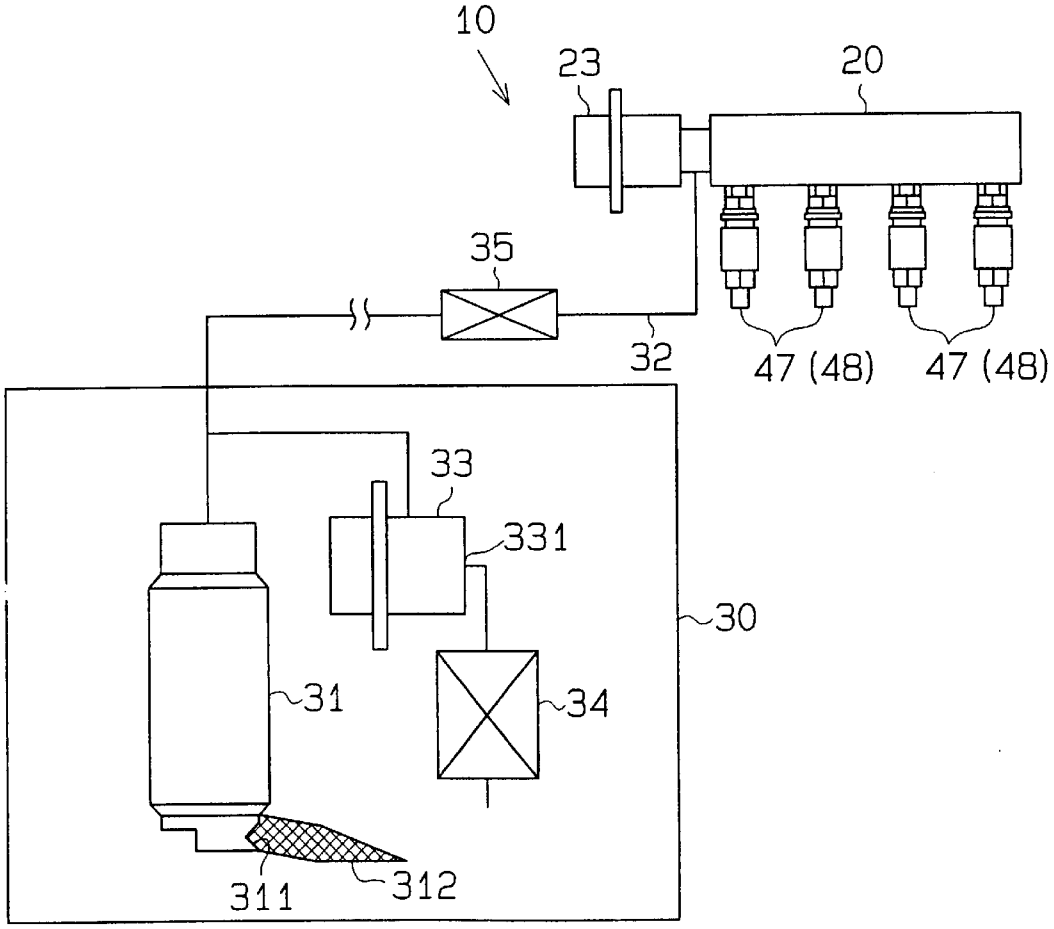
FIG. 1 is a diagrammatic structural view showing a fuel supply system according to the present invention.

First, a fuel delivery system incorporating a fuel delivery apparatus 10 will be described with reference to FIG. 1. In this embodiment, a simplified returnless type fuel delivery apparatus is used. In this type of fuel delivery apparatus, surplus fuel is returned to the fuel stored in a fuel tank 30 within the tank 30.

The fuel delivery system includes a fuel tank 30 for storing fuel, a fuel pump 31 located in the fuel tank 30 and a supply pipe 32. One end of the supply pipe 32 is connected to the fuel pump 31, while the other end is connected to a delivery pipe 20. A filter 312 is attached to a fuel suction port 311 of the fuel pump 31. The filter 312 prevents impurities in fuel from entering the fuel pump 31.

A pressure regulator 33 is located on the supply pipe 32 in the fuel tank 30. The pressure regulator 33 holds the fuel pressure in the supply pipe 32 and a pair of delivery pipes 20 at a predetermined level. The pressure regulator 33 incorporates a diaphragmatic valve (not shown) and a coil spring (not shown) that urges the valve in a closed direction. A low pressure fuel filter 34 is attached to a fuel return port 331 of the pressure regulator 33. A high pressure fuel filter 35 is located on the supply pipe 32 outside the fuel tank 30.

In the above described fuel delivery system, the fuel pump 31 located in the tank 30 draws the fuel from the tank 30 and sends it to the supply pipe 32. When the fuel pressure in the supply pipe 32 exceeds a predetermined level, this high pressure pushes the valve of the pressure regulator 33 in a direction to increase the opening of the valve. Accordingly, a large part of the fuel sent into the supply pipe 32 is returned to the fuel stored in the tank 30 via the pressure regulator 33 and the low pressure fuel filter 34. This drops the fuel pressure in the delivery pipe 20 and the supply pipe 32.

When the fuel pressure in the supply pipe 32 is lower than the predetermined level, on the other hand, the coil spring pushes the valve in the pressure regulator 33 in a direction to decrease the opening of the valve. This decreases the amount of fuel that is returned to the fuel stored in the tank 30 from the supply pipe 32 via the pressure regulator 33. In other words, most of the fuel sent into the supply pipe 32 from the fuel pump 31 is supplied to the delivery pipes 20 via the high pressure fuel filter 35. This increases the fuel pressure in the delivery pipes 20 and the supply pipe 32.

The fuel pressure in the delivery pipes 20 and the supply pipe 32 is always held at a predetermined level by the above described pressure regulator 33.

Figure 2:
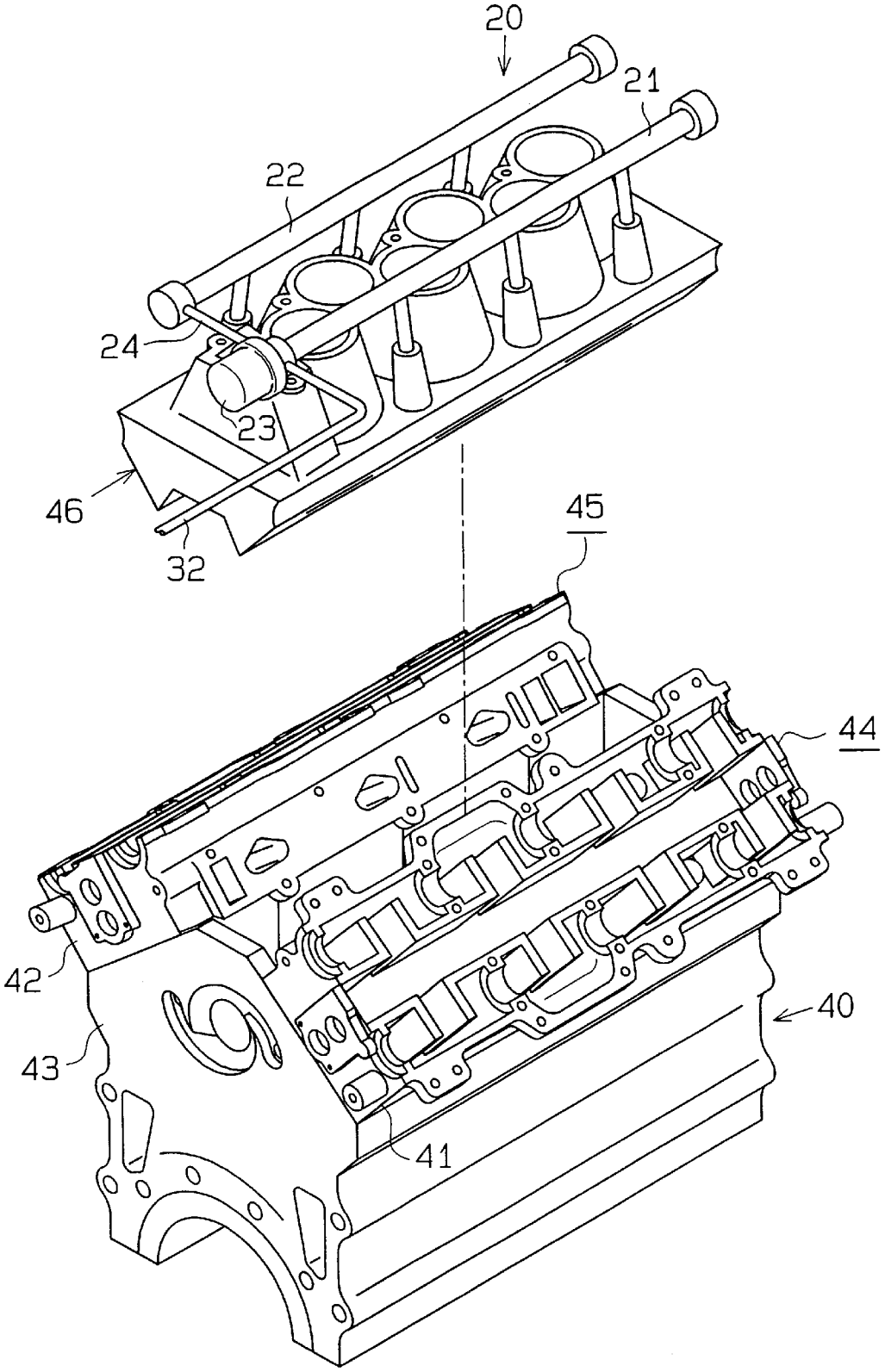
FIG. 2 is a perspective view illustrating a six-cylinder V type engine having a fuel delivery apparatus according to the present invention.
Figure 3:
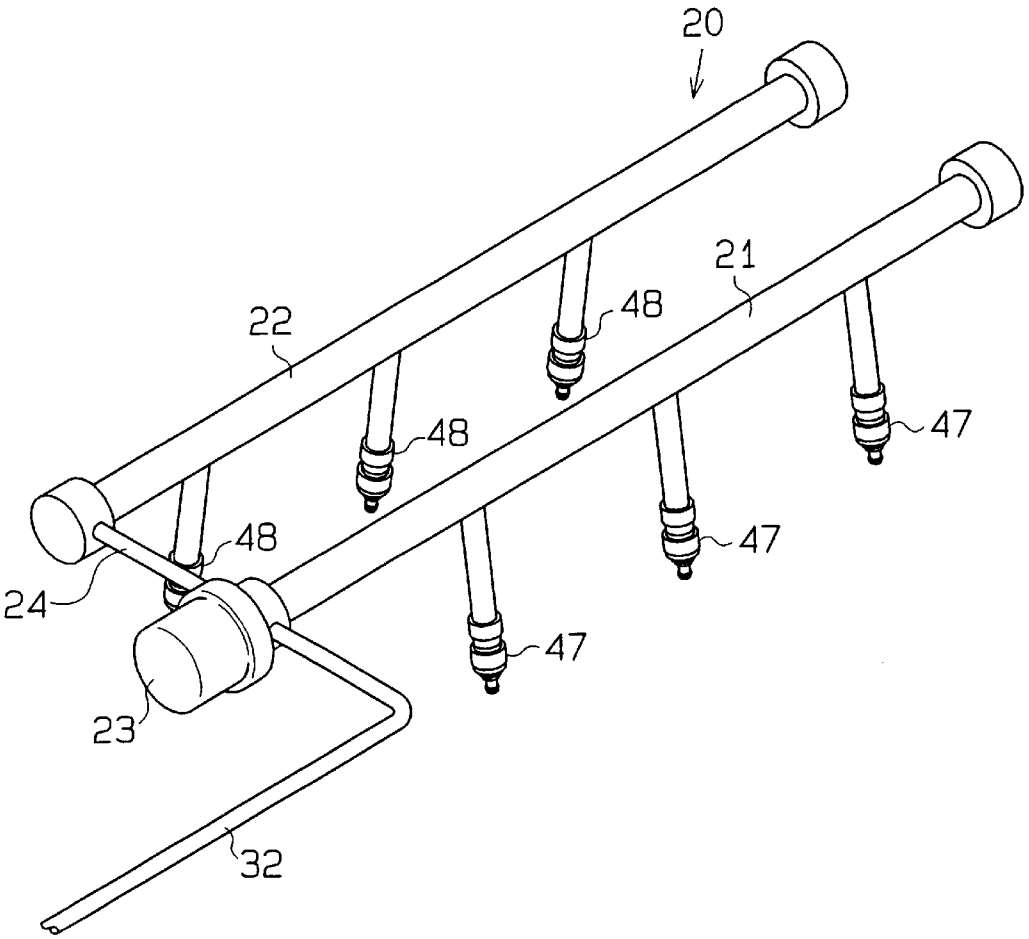
FIG. 3 is a perspective view illustrating delivery pipes.

The fuel delivery apparatus 10 will now be described with reference to FIGS. 2 and 3.

A six-cylinder V-type engine 40 includes a first cylinder head 41 and a second cylinder head 42 secured to the top of a cylinder block 43. A part of the cylinder block 43 and the first cylinder head 41 form a first bank 44, in which three cylinders (not shown) are defined. A part of the cylinder block 43 and the second cylinder head 42 form a second bank 45, in which three cylinders (not shown) are defined. The banks 44, 45 are set at an angle, or a V, to each other.

The delivery pipes 20 are located above an intake manifold 46, and consist of a first delivery pipe 21, which corresponds to the first bank 44, and a second delivery pipe 22, which corresponds to the second bank 45. The first delivery pipe 21 has a three injectors 47, one for each cylinder in the first bank 44. The second delivery pipe 22 has a three injectors 48, one for each cylinder in the second bank 45. The individual injectors 47, 48 each have an electromagnetic valve.

A pulsation damper 23 is attached to the upstream end of the first delivery pipe 21 (the end connected to the supply pipe 32). The pulsation damper 23 damps fluctuations of the fuel pressure. A pipe 24 communicates the upstream end of the first delivery pipe 21 with the upstream end of the second delivery pipe 22.

Figure 4:
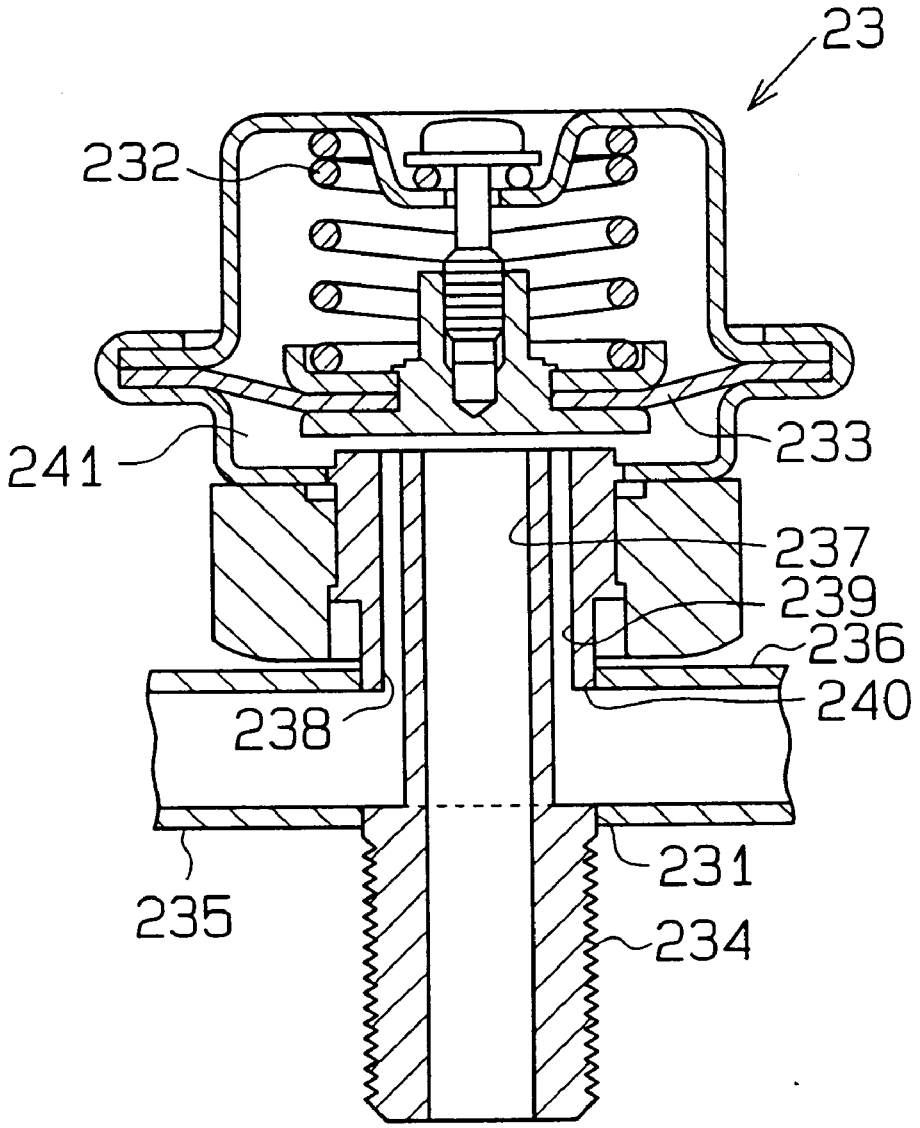
FIG. 4 is an enlarged cross-sectional view illustrating a pulsation damper.

A detailed description will now be given for the pulsation damper 23 with reference to FIG. 4. The pulsation damper 23 has a cylinder 231 and a diaphragm 233 located near a proximal end of the cylinder 231. The diaphragm 233 is urged by a coil spring 232 toward the proximal end of the cylinder 231. A relief chamber 241 is defined between the diaphragm 233 and the proximal end of the cylinder 231. A distal end of the cylinder 231 forms a first connector 234, which is connected to the first delivery pipe 21. A second connector 235, which is connected to the supply pipe 32, and a third connector 236, which is connected to the pipe 24, are formed on the sides of the cylinder 231.

The cylinder 231 includes a first passage 237, a second passage 238, a third passage 239 and a fourth passage 240. The first passage 237 is defined along the center of the cylinder 231 for communicating the relief chamber 241 with the first delivery pipe 21. The second passage 238 is defined next to the first passage 237 along the axis of the cylinder 231 for communicating the supply pipe 32 with the relief chamber 241 via the second connector 235. The third passage 239 is defined next to the first passage 237 along the axis of the cylinder 231 for communicating the relief chamber 241 with the pipe 24 via the third connector 236. The fourth passage 240 is defined around the first passage 237 at a location corresponding to the second and third connectors 235, 236 for communicating the second connector 235 with the third connector 236. In other words, the fourth passage 240 communicates the supply pipe 32 with the pipe 24 without using the relief chamber 241.

The above structure allows the fuel supply passage for the first delivery pipe 21 and the fuel supply passage for the second delivery pipe 22 to be independent from each other. This prevents fuel pressure fluctuation in one of the delivery pipes from affecting fuel pressure fluctuation in the other delivery pipe.

The action for sending the fuel stored in the tank 30 to the delivery pipes 21, 22 from the supply pipe 32 via the pulsation damper 23 will now be described.

An electronic control unit (ECU, not shown) sends injection commands to the injectors 47,48. The ECU sends one injection command at a time to one of the injectors 47, 48 for causing it to inject fuel. The fuel injection from any of the injectors 47, 48 drops the fuel pressure in the delivery pipes 21, 22 lower than a predetermined level. Accordingly, the fuel pressure in the supply pipe 32 drops lower than a predetermined level. This narrows the opening of the valve of the pressure regulator 33 located in the tank 30, thereby decreasing the amount of fuel returned to the fuel stored in the tank 30. Therefore, most of the fuel drawn by the pump 31 is sent to the second connector 235 of the pulsation damper 23 via the supply pipe 32.

The fuel entering the pulsation damper 23 via the second connector 235 flows into the second passage 238 and the fourth passage 240. The fuel in the second passage 238 is drawn into the relief chamber 241, and most of it flows into the first passage 237. The diaphragm 233 dampens the pressure fluctuation of the fuel in the relief chamber 241. Therefore, fuel having little pressure fluctuation enters the first passage 237. The fuel in the first passage 237 is supplied to the first delivery pipe 21 and is then injected from the injectors 47 provided in the first bank 44 based on injection commands from the ECU (not shown).

The fuel drawn in the fourth passage 240, on the other hand, flows into the third connector 236. Part of the fuel, the pressure fluctuation of which has been dampened in the relief chamber 241, enters the third connector 236 via the third passage 239. In other words, fuel having dampened pressure fluctuation and fuel having undampened pressure fluctuation enter the third connector 236. This dampens the pressure fluctuation of the fuel in the third connector 236 to a certain level. The fuel in the third connector 236 is supplied to the second delivery pipe 22 via the pipe 24 and is then injected from the injectors 48 provided in the second bank 45 based on injection commands from the ECU (not shown).

Figure 5:
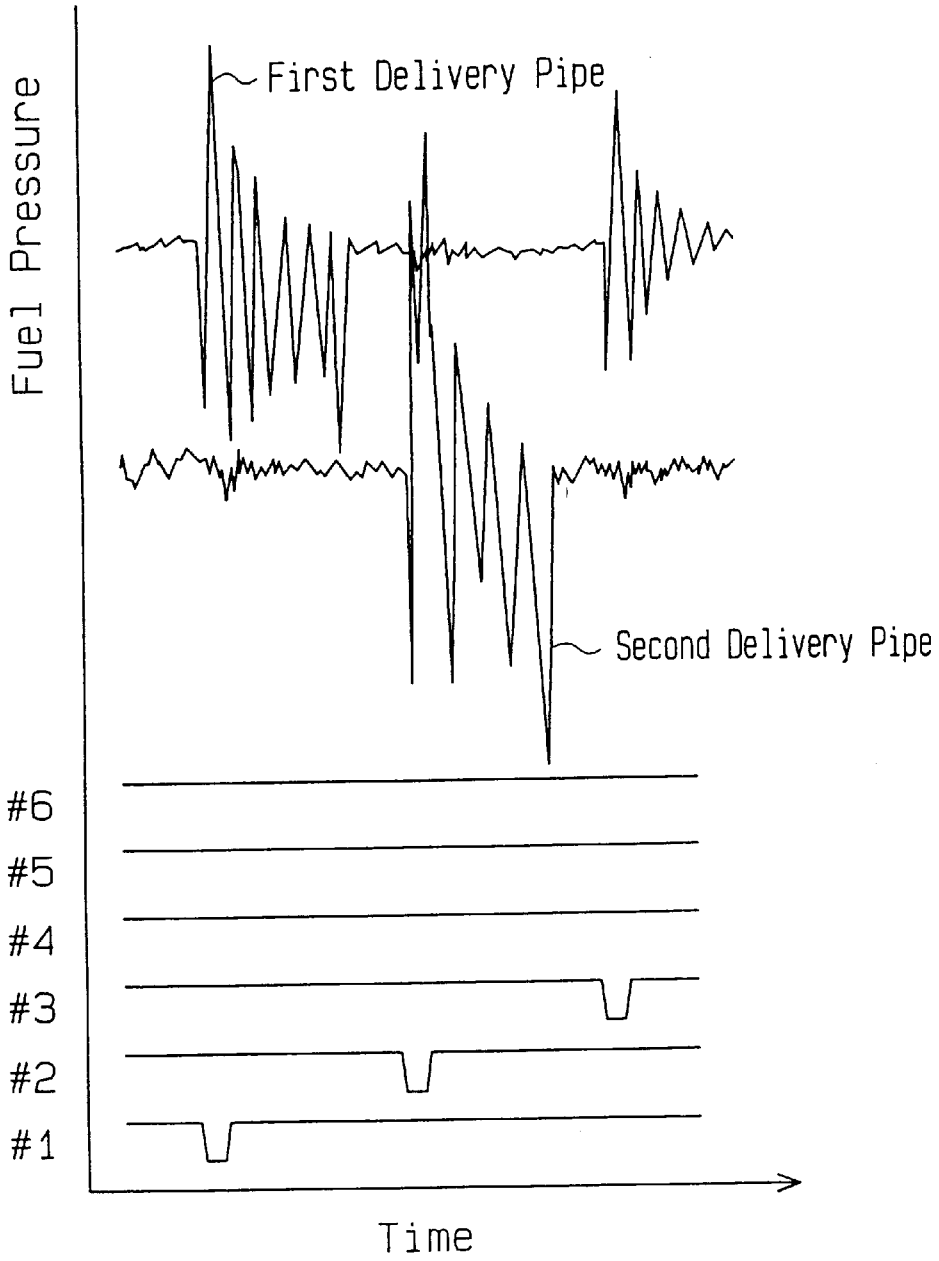
FIG. 5 is a timing chart illustrating the relationship between the fuel pressure fluctuation in each delivery pipe and fuel injection command signals.

The relationship between the fuel pressure fluctuations in the delivery pipes 21, 22 and the fuel injection command signals will now be described with reference to FIG. 5. The upper half of FIG. 5 is a graph showing the changes of the fuel pressures in the individual delivery pipes 21, 22. The lower half of FIG. 5 is a timing chart showing fuel injection timing (fuel injection command signals) of the first to sixth cylinders #1 to #6.

As seen from FIG. 5, when a great pressure fluctuation is caused by a fuel injection into the first cylinder #1, no great pressure fluctuation occurs in the second delivery pipe 22. Likewise, when a great pressure fluctuation is caused by a fuel injection into the second cylinder #2, no great pressure fluctuation occurs in the first delivery pipe 21. This shows that the fuel pressure fluctuation in the first delivery pipe 21 and the fuel pressure fluctuation in the second delivery pipe 22 are independent from each other, or do not affect each other. This is attributed to the independence of the delivery pipes 21, 22.

Therefore, even if a great pressure fluctuation of fuel is generated by a fuel injection from one of the injectors 47, 48, the fluctuation is sufficiently dissipated before the next fuel injection. This prevents continuous existence of significant fuel pressure fluctuations in each of the delivery pipes 21, 22, thereby preventing fuel pressure fluctuation from affecting the fuel injection amount.

Figure 9:
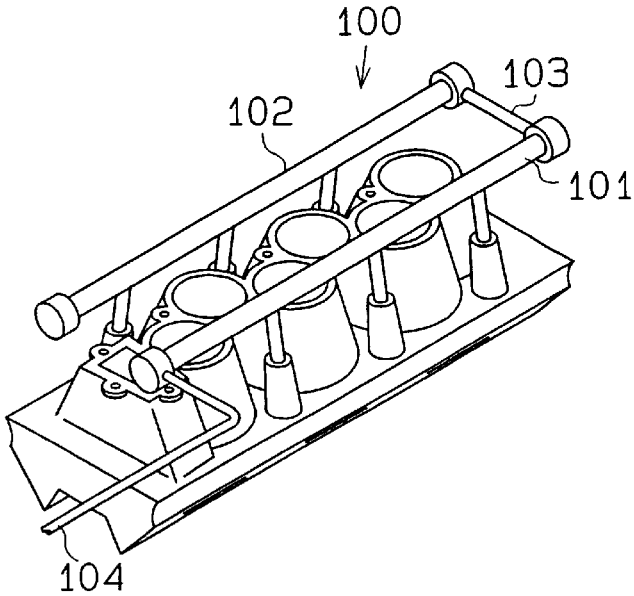
Fig.9(Prior Art)
FIG. 9 is a perspective view illustrating delivery pipes of a prior art fuel delivery apparatus.
Figure 10:
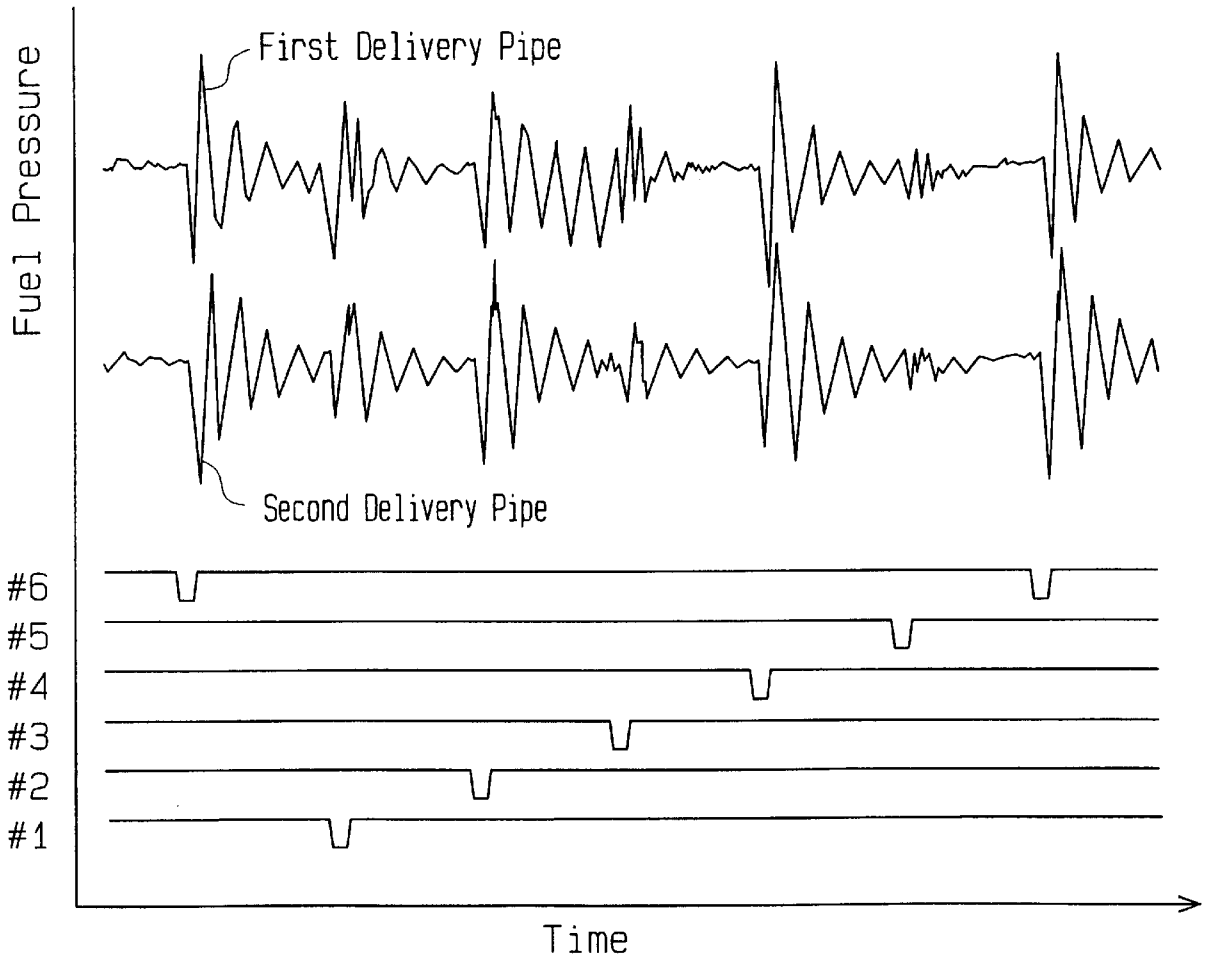
Fig.10(Prior Art)
FIG. 10 is a timing chart illustrating the relationship between the fuel pressure fluctuation in each delivery pipe and fuel injection command signals in the prior art apparatus of FIG. 9.
Figure 11:
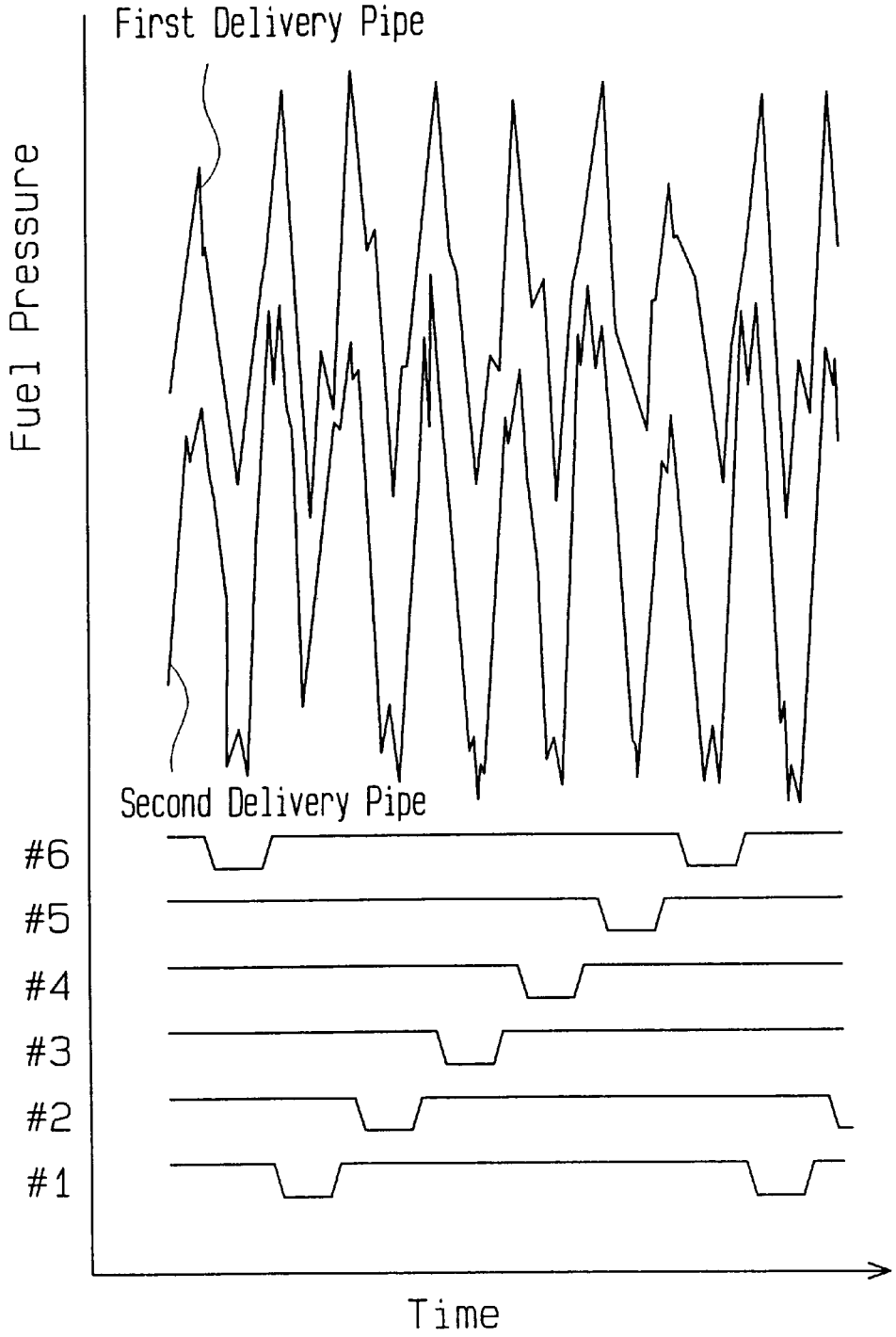
Fig.11 (Prior Art)
FIG. 11 is a timing chart illustrating the relationship between the fuel pressure fluctuation in each delivery pipe and fuel injection command signals when resonance is occurring in the apparatus of FIG. 9.
Figure 12:
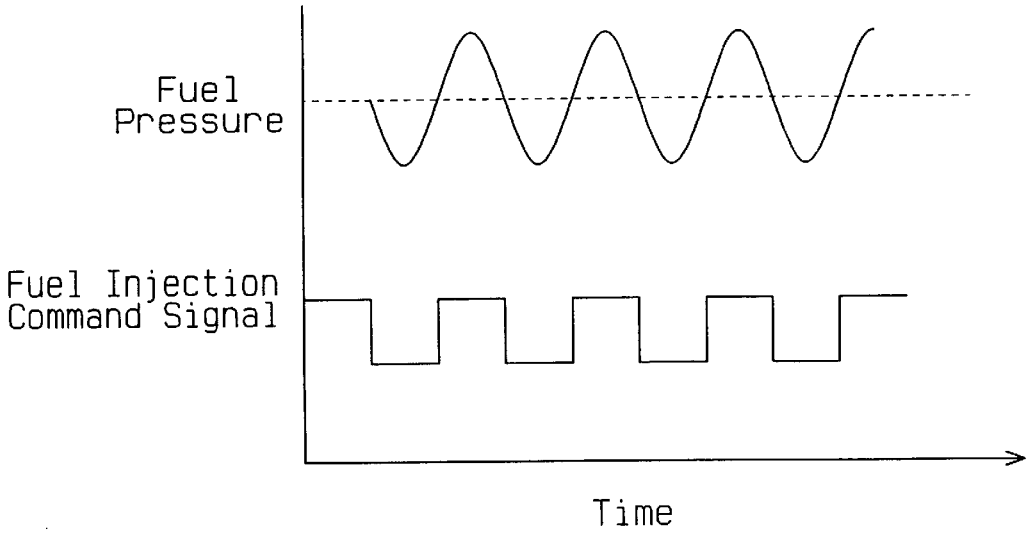
Fig.12(Prior Art)
FIG. 12 is a timing chart diagrammatically illustrating the relationship between the fuel pressure fluctuation in a delivery pipe and fuel injection command signals when resonance is occurring in the apparatus of FIG. 9.

Contrary to the above embodiment, in the prior art fuel delivery apparatus 100 shown in FIG. 9, when a great pressure fluctuation of fuel occurs in one of the delivery pipes, a great pressure fluctuation of fuel also occurs in the other delivery pipe. Therefore, in each of the delivery pipes 101, 102, a great fuel pressure fluctuation occurs before the previous great fuel pressure fluctuation caused is sufficiently dissipated. Accordingly, fuel pressure fluctuation continuously exists in the delivery pipes 101, 102. This varies the amount of the fuel injected from the injectors. Further, the resonance generated in the delivery pipes 101, 102 as described previously greatly increases the fuel pressure fluctuations, thereby greatly affecting the amount of fuel injected from the injectors.

In the prior art fuel delivery apparatus 100, fuel is supplied to the second delivery pipe 102 via the first delivery pipe 101. Therefore, the actual length of the fuel passage is equal to the combined length of the first delivery pipe 101, the pipe 103 and the second delivery pipe 102. In an experiment, the resonance frequency of the delivery pipes was 175 Hz. A fuel pressure fluctuation having the same frequency as the resonance frequency of the delivery pipes occurred in the delivery pipes 101, 102 when the engine speed (resonance engine speed) was 3500 rpm. This shows that the resonance occurs in the so-called practical engine speed region in which the engine is normally operated. The resonance greatly magnifies the variation of the amount of injected fuel, thereby varying the air-fuel ratio.

In the fuel delivery apparatus 10 according to the above described embodiment of the present invention, the first delivery pipe 21 and the second delivery pipe 22 are independent from each other. The effective length of the fuel passages matches the length of each delivery pipe. Thus, the effective fuel passage length is shorter than that of the fuel passage in the prior art. The first delivery pipe 21 further includes the pulsation damper 23 attached to its upstream end. This structure shifts the resonance frequencies of the first and second delivery pipes 21, 22 to higher frequencies. Specifically, the resonance frequency of the first delivery pipe 21 is 350 Hz and the resonance frequency of the second delivery pipe 22 is 208 Hz, which are significantly different from each other.

The fuel pressure in one of the delivery pipes is not affected by the fuel pressure in the other delivery pipe. This elongates the interval between fuel pressure fluctuations in comparison with the prior art. The resonance engine speed of the first delivery pipe 21 is 14000 rpm and that of the second delivery pipe 22 is 8320 rpm. These engine speeds are widely outside of the practical engine speed region. Therefore, in the practical engine speed region, variation of the injected fuel amount caused by resonance does not occur. The air-fuel ratio is thus unaffected and is more predictable.

As described above, in the fuel delivery apparatus 10 according to the present invention, the first delivery pipe 21 and the second delivery pipe 22 are arranged such that the fuel pressure fluctuation in one of the delivery pipes 21, 22 does not affect the other delivery pipe (in other words, there are two fuel passages that are independent from each other). The first delivery pipe 21 has a pulsation damper 23 attached to the upstream end thereof.

Therefore, unlike the prior art fuel delivery apparatus 100, even if a fuel pressure fluctuation is generated in the first delivery pipe 21 by a fuel injection from one of the injectors 47 of the first delivery pipe 21 as shown in FIG. 5, the generated fluctuation does not fluctuate the fuel pressure in the second delivery pipe 22. Also, a fuel pressure fluctuation generated in the second delivery pipe 22 does not affect the fuel pressure in the first delivery pipe 21. Moreover, the resonance frequencies of the first and the second delivery pipes 21, 22 are higher in comparison with that of the prior art fuel delivery apparatus 100. Further, the resonance frequency of the first delivery pipe 21 and that of the second delivery pipe 22 differ.

The above structure causes the engine speed that generates the fuel pressure fluctuations having the resonance frequencies of the delivery pipes 21, 22, or the resonance engine speed, to be widely outside of the practical engine speed region. Therefore, in the practical engine speed region, no great fuel pressure fluctuation is generated by resonance, and no variation of the injected fuel amount is caused by pressure fluctuations. In the practical engine speed region, an injected fuel amount that accomplishes the air-fuel ratio computed by the ECU based on the engine's conditions is thus obtained.

Even if a great fuel pressure fluctuation occurs in the delivery pipes 21, 22 in the resonance-free engine speed region, the pressure fluctuation is sufficiently dissipated by the next fuel injection. Accordingly, the fuel pressures in the delivery pipes 21, 22 are held substantially at the predetermined level. As a result, the above described embodiment restrain fuel pressure fluctuations when there is no resonance in the delivery pipes. The fuel amount injected from the injectors is thus accurately controlled.

The prior art fuel delivery apparatus 100 requires a pipe for connecting the first delivery pipe 101 to the second the delivery pipe 102 and a pipe for supplying fuel to the upstream end of the first delivery pipe 101. Unlike the prior art, the above described embodiment may use a single pipe for supplying fuel to the first delivery pipe and for connecting the first and the second delivery pipes to each other. This reduces the number of the parts in the apparatus, thereby facilitating the assembly and inspection of the apparatus.

Figure 6:
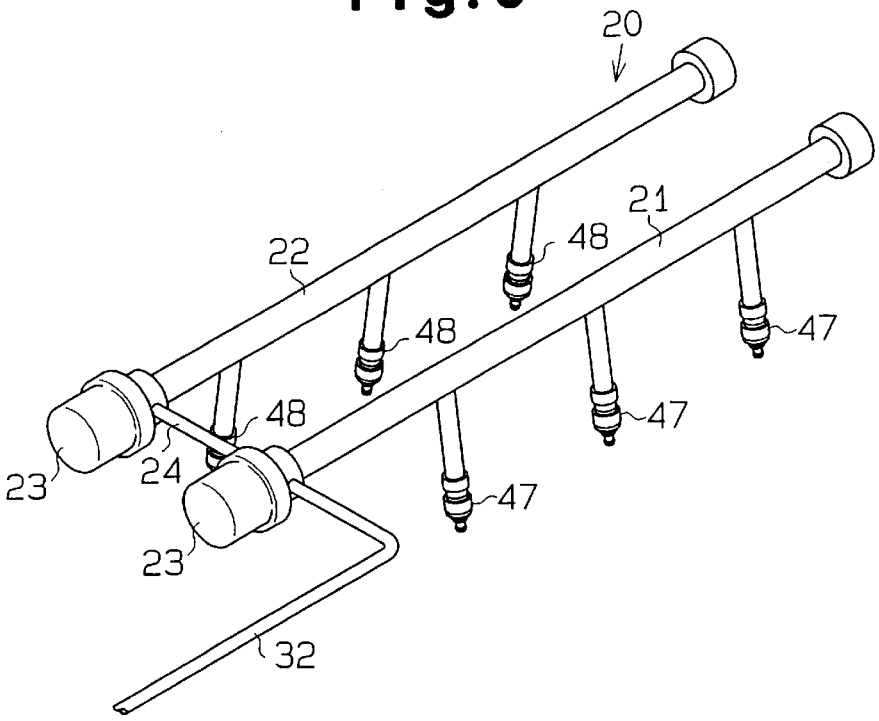
FIG. 6 is a perspective view illustrating a second embodiment of the present invention.

The above embodiment may be modified as follows:

(1) In the above described embodiment, the pulsation damper 23 is attached only to the upstream end of the first delivery pipe 21. However, as in a second embodiment shown in FIG. 6, an additional pulsation damper 23 may be attached to the upstream end of the second delivery pipe 22.

As described above, attaching a pulsation damper to a delivery pipe increases the resonance frequency of the delivery pipe and changes the resonance engine speed. Eight-cylinder V-type engines, ten-cylinder V-type engines and twelve-cylinder V-type engines have longer delivery pipes in comparison with those of six-cylinder V-type engines. Accordingly, the resonance frequency of the delivery pipes in eight to twelve-cylinder V-type engines are lower. Therefore, attaching the pulsation dampers 23 to the upstream ends of first and second delivery pipes 21, 22 in engines having elongated delivery pipes is especially effective for increasing the resonance frequency of the delivery pipes 21, 22. This structure eliminates variation of the injected fuel amount, which would otherwise be generated by a resonance of the delivery pipes. Resonance is prevented in the practical engine speed region, even in V-type engines having many cylinders, thereby stabilizing the air-fuel ratio.

Figure 7:
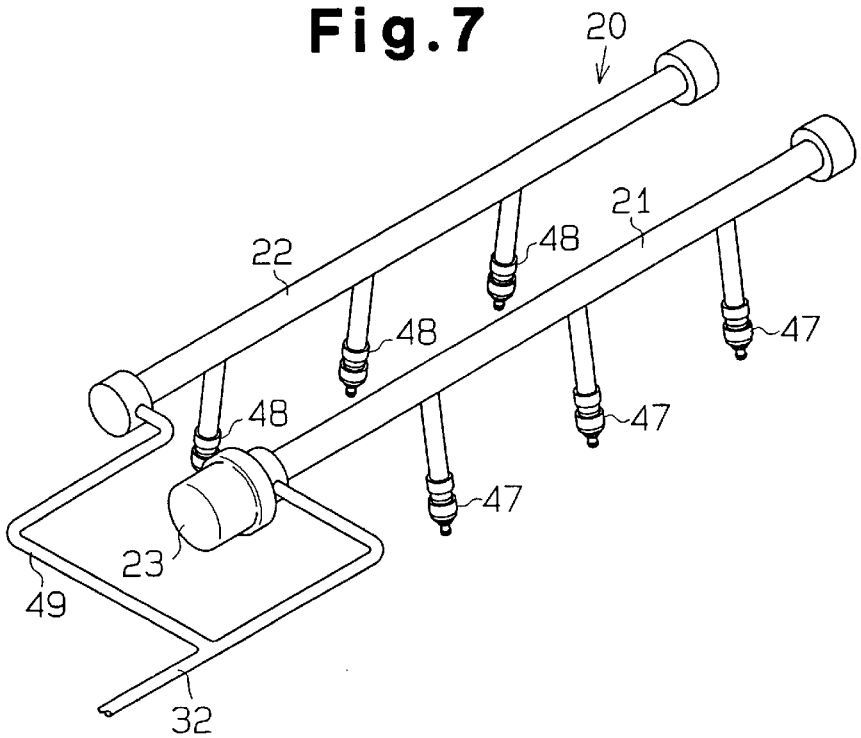
FIG. 7 is a perspective view illustrating a third embodiment of the present invention.
Figure 8:
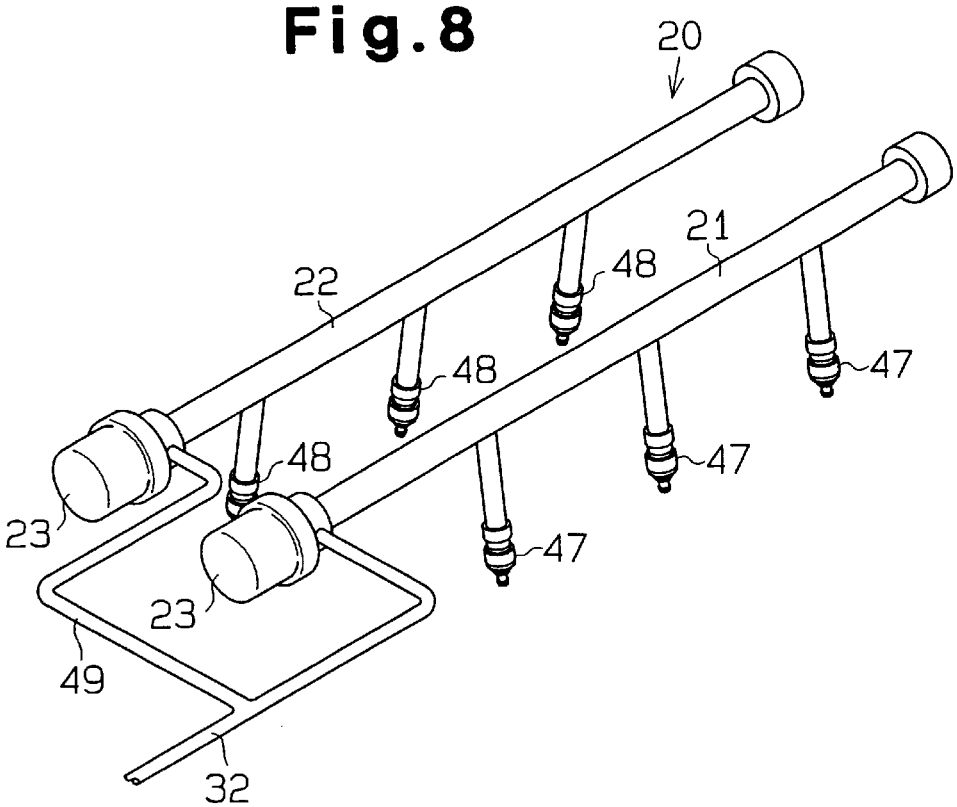
FIG. 8 is a perspective view illustrating a fourth embodiment of the present invention.

(2) In the above described embodiment, fuel is supplied to the second delivery pipe 22 via the pulsation damper 23 attached to the upstream end of the first delivery pipe 21, and the pipe 24. However, as in a third embodiment shown in FIG. 7, a branch pipe 49 may be used to communicate the supply pipe 32 with the upstream end of the second delivery pipe 22 instead of connecting the delivery pipes 21 and 22 by the pipe 24. Or, as in a fourth embodiment shown in FIG. 8, when the pulsation dampers 23 are attached to the second delivery pipe 22 as well as to the first delivery pipe 21, the discharge port of the branch pipe 49 may be connected to the pulsation damper 23 of the second delivery pipe 22. The structures in the third and fourth embodiments also allow the fuel passages to the first and second delivery pipes to be independent from each other.

Therefore, the present examples and embodiments are to be considered as illustrative and not restrictive and the invention is not to be limited to the details given herein but may be modified within the scope of the appended claims.

What is claimed is:

1. An apparatus for delivering fuel to a V-type engine having a first bank and a second bank, the apparatus comprising:

a first delivery pipe associated with the first bank;

a second delivery pipe associated with the second bank;

a fuel pipe having a supply pipe connected with a fuel tank and a communicating pipe connected with an upstream end of the second delivery pipe;

a first dampener connected with an upstream end of the first delivery pipe, a downstream end of the supply pipe and an upstream end of the communicating pipe, the first dampener having a relief chamber for damping pressure fluctuation of the fuel, a first passage for introducing some of the fuel supplied from the supply pipe to the first delivery pipe via the relief chamber and a second passage for directly introducing some to the fuel supplied from the supply pipe to the communicating pipe, wherein the first dampener damps pressure fluctuation of the fuel flowing in the first passage;

a plurality of injectors provided with the first and second delivery pipes, the injectors injecting the fuel from the first and second delivery pipes to cylinders of the engine, respectively;

a pump located in the fuel tank to supply fuel from the fuel tank to the supply pipe; and a pressure regulator located in the fuel tank, the pressure regulator controlling the amount of fuel returning from the supply pipe to the fuel tank in accordance with the fuel pressure in the supply pipe to keep the fuel pressure in the fuel pipe and the delivery pipes at a predetermined level without returning the fuel from the delivery pipes to the fuel tank.

2. An apparatus for delivering fuel to a V-type engine having a first bank and a second bank, the apparatus comprising:

a first delivery pipe associated with the first bank;

a second delivery pipe associated with the second bank;

a fuel pipe having a supply pipe connected with a fuel tank and a branch pipe directly connected with an upstream end of the second delivery pipe and the supply pipe;

a first dampener connected with an upstream end of the first delivery pipe, a downstream end of the supply pipe, the first dampener having a first passage for introducing the fuel supplied from the supply pipe to the first delivery pipe, wherein the first dampener damps pressure fluctuation of the fuel supplied from the supply pipe and introduces damped fuel to the first delivery pipe;

a plurality of injectors provided with the first and second delivery pipes, the injectors injecting the fuel from the first and second delivery pipes to cylinders of the engine, respectively;

a pump located in the fuel tank to supply fuel from the fuel tank to the supply pipe; and a pressure regulator located in the fuel tank, the pressure regulator controlling the amount of fuel returning from the supply pipe to the fuel tank in accordance with the fuel pressure in the supply pipe to keep the fuel pressure in the fuel pipe and the delivery pipes at a predetermined level without returning the fuel from the delivery pipes to the fuel tank.

3. The apparatus according to claim 1, wherein said first dampener has a third passage for introducing a portion of the fuel in the relief chamber with the damped pressure fluctuation to the communicating pipe.

4. The apparatus according to claim 1 further comprising a second dampener disposed at the first end of the second delivery pipe to damp the pressure fluctuation of the fuel supplied from the communicating pipe.

5. The apparatus according to claim 2 further comprising a second dampener disposed at the first end of the second delivery pipe to damp the pressure fluctuation of the fuel supplied from the branch pipe.

* * * * *